US005284093A

United States Patent [19]

Guaraldi et al.

[11] Patent Number: 5,284,093

[45] Date of Patent: Feb. 8, 1994

[54] PLATE CYLINDER WITH SEMI-AUTOMATIC PLATE LOCK UP

[75] Inventors: Glenn A. Guaraldi, Kingston; Bertrum S. Ramsay, Alton; Warren H. Jarrard, Rochester, all of N.H.

[73] Assignee: Heidelberg Harris Inc., Dover, N.H.

[21] Appl. No.: 24,391

[22] Filed: Feb. 24, 1993

[51] Int. Cl.[5] ..... B41F 1/28

[52] U.S. Cl. ..... 101/415.1

[58] Field of Search ..... 101/378, 415.1

[56] References Cited

U.S. PATENT DOCUMENTS

| | | | |
|---|---|---|---|
| 2,050,950 | 8/1936 | Huck | 101/378 |
| 2,965,025 | 12/1960 | Mueller | 101/415.1 |
| 3,191,532 | 6/1965 | Hermach et al. | 101/415.1 |
| 3,563,176 | 2/1971 | Ferguson | 101/415.1 |
| 3,659,525 | 5/1972 | Woessner et al. | 101/378 |
| 3,727,551 | 4/1973 | Kostas et al. | 101/415.1 |
| 3,738,268 | 6/1973 | Swordy et al. | 101/415.1 |
| 3,913,480 | 10/1975 | Dauner et al. | 101/378 |
| 4,036,133 | 7/1977 | Kocsis et al. | 101/415.1 |
| 4,130,058 | 12/1978 | Bock | 101/415.1 |
| 4,502,388 | 3/1985 | Ishii | 101/415.1 |
| 4,510,868 | 4/1985 | Fischer | 101/415.1 |
| 4,730,557 | 3/1988 | Wieland | 101/415.1 |
| 4,938,134 | 7/1990 | Dorsam et al. | 101/415.1 |
| 4,938,135 | 7/1990 | Wieland | 101/415.1 |
| 5,010,818 | 4/1991 | Wallschlaeger | 101/378 |

*Primary Examiner*—Eugene H. Eickholt

*Attorney, Agent, or Firm*—Tarolli, Sundheim & Covell

[57] ABSTRACT

A rotatable plate cylinder (10) for supporting a printing plate (150) has an open passage (34) and a locking member (26) supported for movement in the passage (34). The locking member (26) is movable inward of the passage (34) to a closed position, and is movable outward of the passage (34) to an open position. The locking member (26) is subjected to a first centrifugal force which urges it to move outward from the closed position toward the open position when the plate cylinder (10) rotates. A balance member (28) is subjected to a second centrifugal force when the plate cylinder (10) rotates. Connecting pins (100) direct the second centrifugal force against the locking member (26) oppositely to the first centrifugal force.

20 Claims, 4 Drawing Sheets

PLATE CYLINDER WITH SEMI-AUTOMATIC PLATE LOCK UP

FIELD OF THE INVENTION

The present invention relates to a plate cylinder for supporting a printing plate in a printing unit.

BACKGROUND OF THE INVENTION

A plate cylinder supports a printing plate in a printing unit. The plate cylinder is supported in the printing unit to rotate about its axis. The printing plate has a surface which defines the image to be printed. Ink is applied to the printing plate on the plate cylinder, and the inked image is printed on paper or other material when the cylinder rotates.

The printing plate is formed as a thin sheet of metal, and is mounted on the plate cylinder by wrapping the sheet around the cylindrical outer surface of the cylinder. When the plate is thus mounted on the cylinder, opposite edges of the plate extend along the length of the cylinder. A locking mechanism within the cylinder engages the opposite edges of the plate to hold the plate on the cylinder when the cylinder rotates.

SUMMARY OF THE INVENTION

In accordance with the present invention, a rotatable plate cylinder has a locking means for securing a printing plate to the cylinder. The cylinder comprises a body with a cylindrical outer surface. The locking means includes a passage with an opening at the cylindrical outer surface of the cylinder. The passage extends into the cylinder from the opening. The locking means further includes a locking member supported for movement in the passage between a closed position and an open position.

The locking means secures the printing plate to the plate cylinder when the locking member is in the closed position, and releases the printing plate from the plate cylinder when the locking member is in the open position. The locking member is movable outward of the passage from the closed position toward the open position when the plate cylinder rotates.

The mass of the locking member subjects the locking member to a first centrifugal force when the plate cylinder rotates. The first centrifugal force urges the locking member to move outward of the passage from the closed position toward the open position.

The plate cylinder further comprises a balance member and a force balancing means. The mass of the balance member subjects the balance member to a second centrifugal force when the plate cylinder rotates. The force balancing means directs the second centrifugal force against the locking member oppositely to the first centrifugal force, and in an amount great enough not to permit the first centrifugal force to move the locking member out of the closed position.

BRIEF DESCRIPTION OF THE DRAWINGS

The foregoing and other features of the present invention will become apparent to those skilled in the art upon reading the following description of preferred embodiments of the invention in view of the accompanying drawings, wherein.

DESCRIPTION OF PREFERRED EMBODIMENTS

Figure 1:
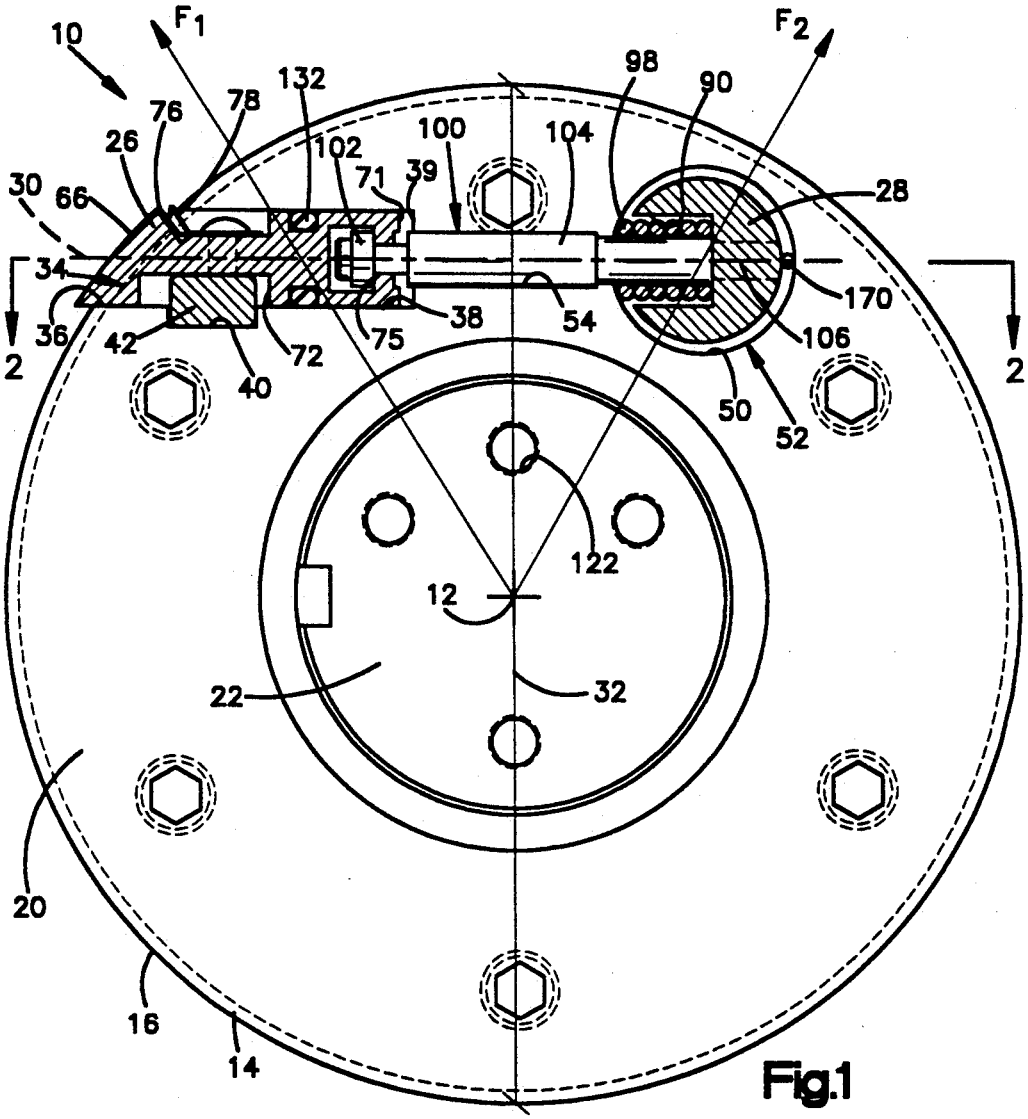
FIG. 1 is an end view of a plate cylinder constructed in accordance with the present invention.

As shown in FIG. 1, a plate cylinder 10 constructed in accordance with the present invention has a longitudinal central axis 12 and a body 14. The body 14 has a cylindrical outer surface 16 centered on the axis 12. Each end of the plate cylinder 10 has an end cap 20 and a stub shaft 22 centered on the axis 12. The stub shafts 22 support the plate cylinder 10 for rotation about the axis 12 in a printing unit. The plate cylinder 10 also has a lockup bar 26 and a balance bar 28. The lockup bar 26 and the balance bar 28 cooperate to hold a printing plate in an installed position in which the printing plate is wrapped around the cylindrical outer surface 16.

The plate cylinder 10 also has a transverse axis 30. The transverse axis 30 is spaced radially from the longitudinal central axis 12, and is perpendicular to a diametrical line 32 which defines the diameter of the cylindrical outer surface 16. An open passage 34 in the plate cylinder 10 extends along the length of the body 14, and extends inward from the body 14 along the transverse axis 30. The open passage 34 has an outer end 36 which is open at the cylindrical outer surface 16. The open passage 34 also has an inner end portion 38 with an inner end surface 39, and a recessed portion 40. A safety block 42 is fixed to the plate cylinder 10 in the recessed portion 40 of the open passage 34, and extends along the length of the open passage 34.

Figure 2:
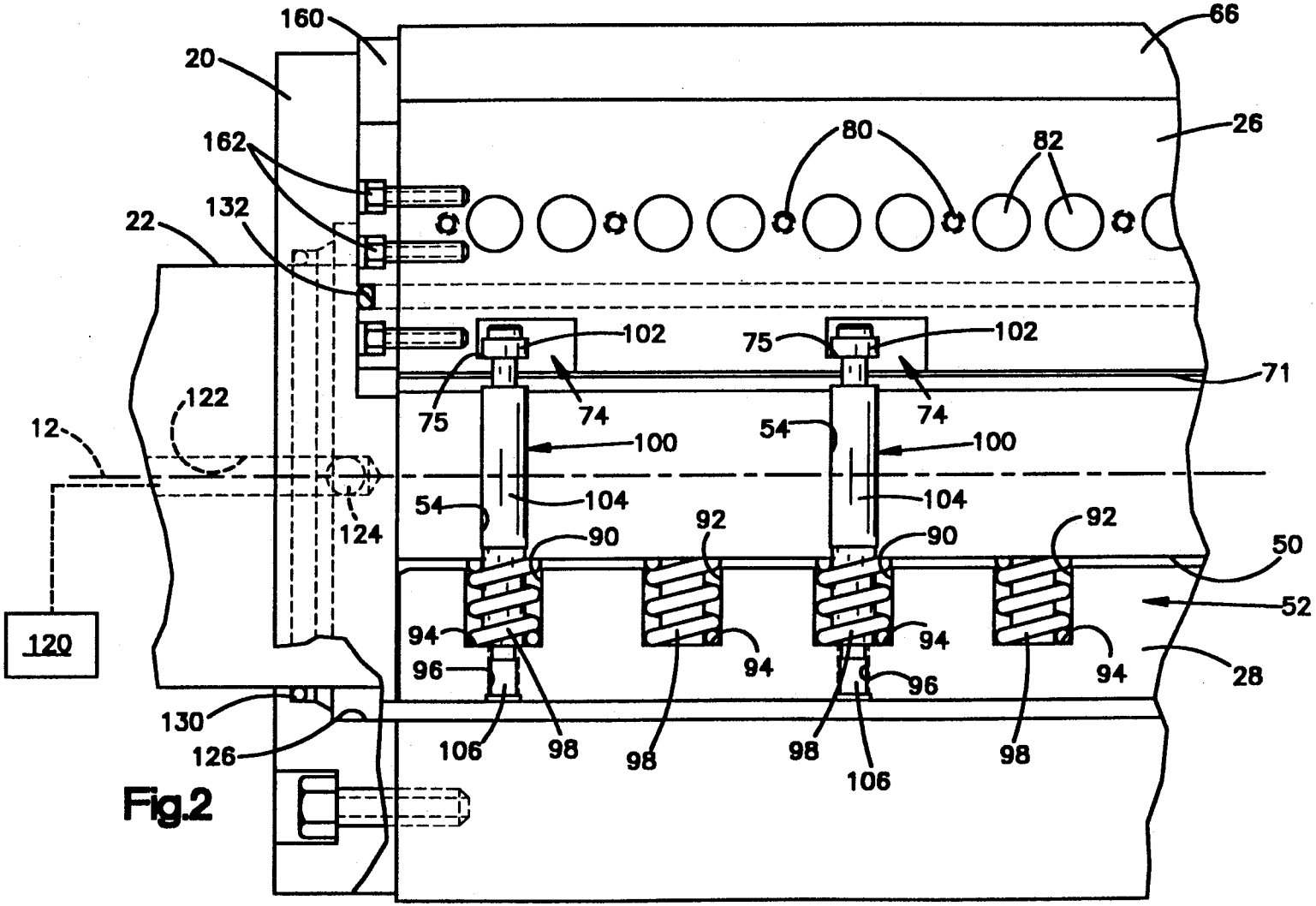
FIG. 2 is a view taken on line 2—2 of FIG. 1.

The plate cylinder 10 further has an inner surface 50 defining a cylindrical chamber 52. The cylindrical chamber 52 extends along the length of the body 14, and communicates with the open passage 34 through a plurality of connecting passages 54. As shown in FIG. 2, the connecting passages 54 are spaced from each other along the length of the plate cylinder 10.

The lockup bar 26 is located in the open passage 34, and is movable back and forth along the transverse axis 30. The lockup bar 26 extends along the length of the open passage 34 as shown in FIG. 2, and extends transversely in the open passage 34 as shown in FIG. 1.

Figure 1A:
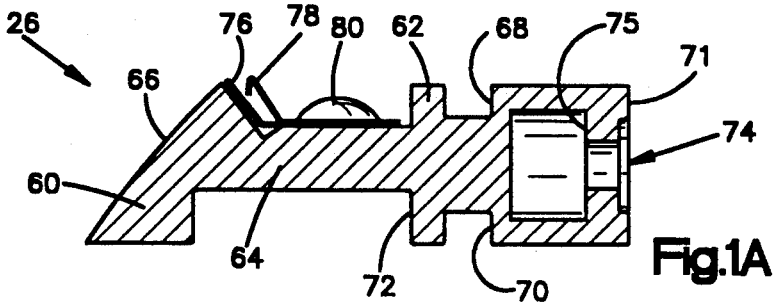
FIG. 1*a* is a sectional view of a part shown in FIG. 1.

As shown in FIG. 1A, the lockup bar 26 has an outer end portion 60, an inner end portion 62 and an intermediate portion 64. The outer end portion 60 of the lockup bar 26 has an outer surface 66 with a cylindrical contour matching the contour of the cylindrical outer surface 16 of the body 14. The inner end portion 62 of the lockup bar 26 has an upper groove 68, a lower groove 70, an inner end surface 71 and a stop surface 72. The inner end portion 62 also has a plurality of slots 74. Each slot 74 contains an abutment surface 75. As shown in FIG. 2, the slots 74 are spaced from each other along the length of the lockup bar 26. The intermediate portion 64 of the lockup bar 26 supports a tension spring 76 and a retainer spring 78. The tension spring 76 and the retainer spring 78 are leaf springs which extend along the length of the lockup bar 26, and are fixed to the lockup bar 26 by fasteners 80. The intermediate portion 64 of the lockup bar 26 also has a plurality of cavities 82 which are formed in the lockup bar 26 to reduce its weight.

The balance bar 28 is located in the cylindrical chamber 52 and also is movable back and forth along the transverse axis 30. The balance bar 28 has a plurality of bores spaced apart along its length, including first bores 90 and second bores 92. As shown in FIG. 2, the first bores 90 are aligned with the connecting passages 54 which communicate the cylindrical chamber 52 with the open passage 34. The second bores 92 are spaced from the connecting passages 54. Each of the first and second bores 90 and 92 has an inner surface 94. Each of the first bores 90 further has an internally threaded portion 96.

A plurality of coil springs 98 are received in the bores 90 and 92 in the balance bar 28. Each of the coil springs 98 extends from the inner surface 50 in the cylindrical chamber 52 to the respective inner bore surface 94. The coil springs 98 exert a spring force against the balance bar 28 which urges the balance bar 28 to move along the transverse axis 30 in a direction to the right as viewed in FIG. 1.

The lockup bar 26 is connected to the balance bar 28 by a plurality of connecting pins 100. Each of the connecting pins 100 has a head 102, an elongated body 104, and an externally threaded end portion 106. The head 102 on each connecting pin 100 is received in a respective one of the slots 74 in the lockup bar 26, and abuts the abutment surface 75 in the slot 74. The body 104 of each connecting pin 100 extends from the lockup bar 26 to the balance bar 28 through a respective one of the connecting passages 54. The threaded end portion 106 of each connecting pin 100 is engaged in a respective internally threaded bore portion 96 in the balance bar 28. The connecting pins 100 thus connect the lockup bar 26 with the balance bar 28 so that the coil springs 98 urge both the lockup bar 26 and the balance bar 28 to move along the transverse axis 30 in a direction to the right as viewed in FIG. 1. The balance bar 28 limits movement of the lockup bar 26 along the transverse axis 30 to the left as viewed in FIG. 3 when the lockup bar 28 moves into contact with the inner surface 50 of the plate cylinder 10. If the connecting pins 100 move to break, the safety block 42 would safely hold the lockup bar 26 in the open passage 34.

The plate cylinder 10 further includes a plurality of air flow passages. The air flow passages direct a pressurized flow of air selectively from a source 120 to the lockup bar 26. The air flow passages include an axial passage 122 which extends axially in the stub shaft 22, and a radial passage 124 which extends radially from the axial passage 122. An annular passage 126 is defined between the stub shaft 22 and the end cap 20 of the plate cylinder 10. A first O-ring 130 pneumatically seals the annular passage 126. The annular passage 126 communicates the radial passage 124 with the cylindrical chamber 52 in which the balance bar 28 is located. The cylindrical chamber 52 in turn communicates pneumatically with the open passage 34 through small clearances between the bodies 104 of the connecting pins 100 and the cylindrical walls of the connecting passages 54. The inner end portion 38 of the open passage 34 is sealed pneumatically, as well as from the ingress of dirt or other contaminants, from the outer end 36 of the open passage 34 by a second O-ring 132. The second O-ring 132 extends around the lockup bar 26 in the grooves 68 and 70.

Figure 3:
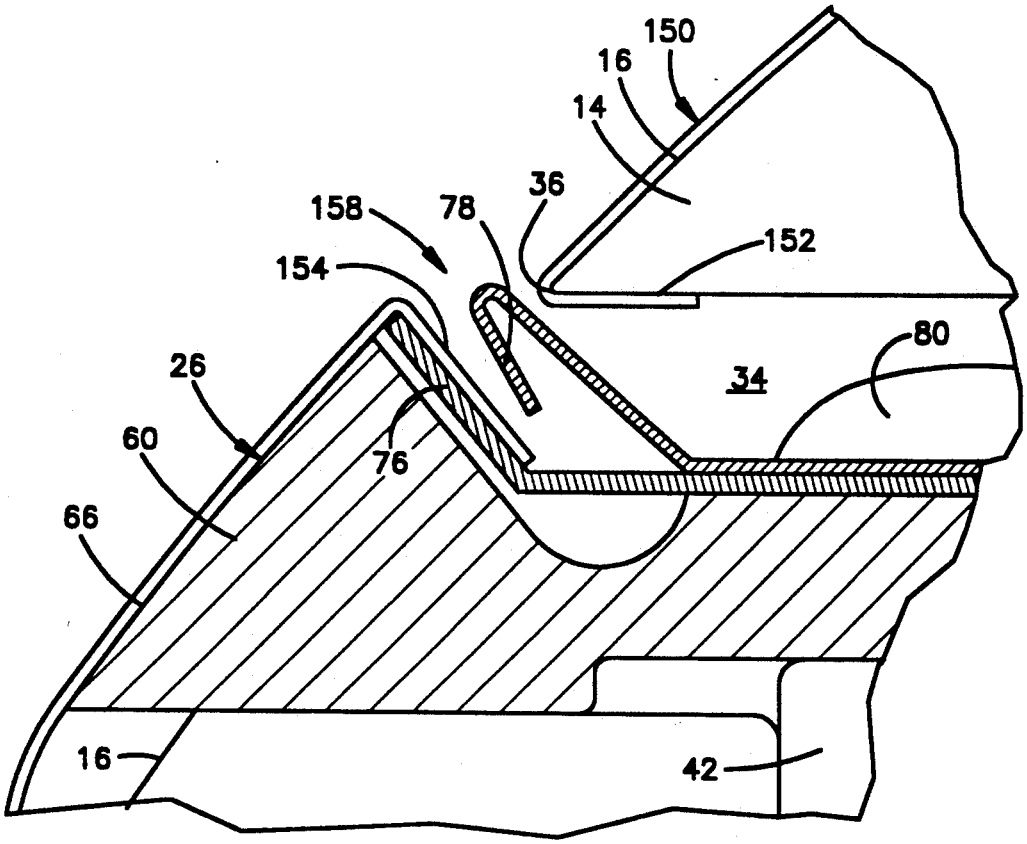
FIG. 3 is an enlarged partial view of parts shown in FIG. 1.
Figure 4:
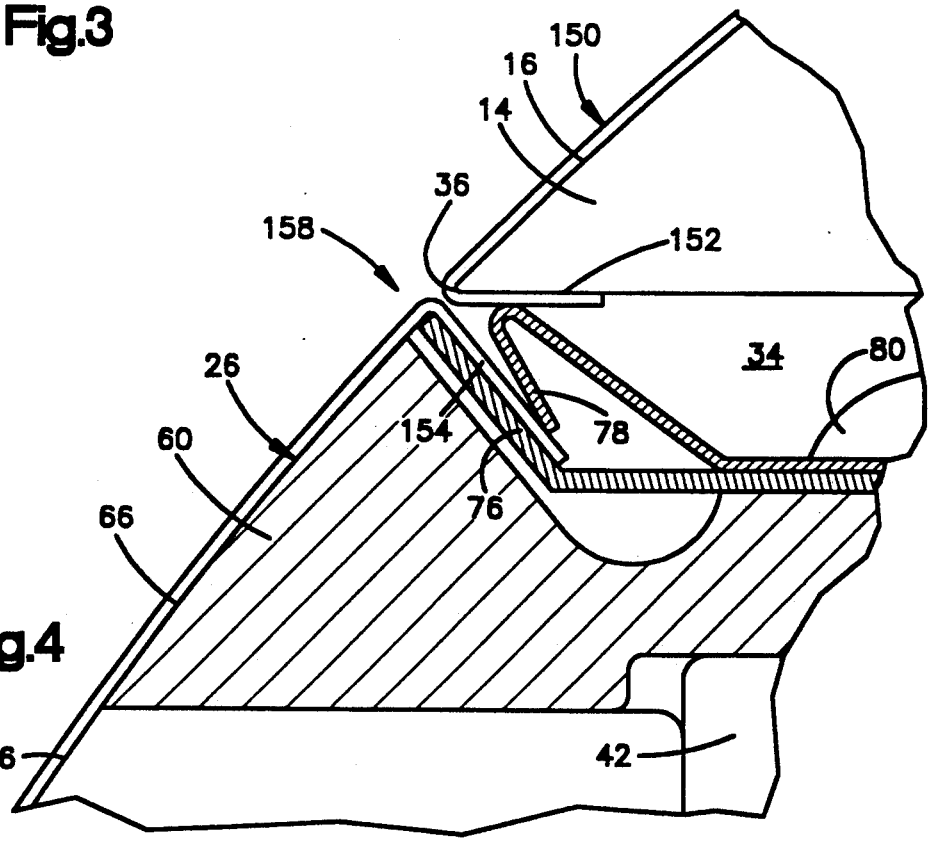
FIG. 4 is a view of the parts shown in FIG. 3 in different positions.

A printing plate 150 is mounted on the plate cylinder 10 as shown in FIGS. 3 and 4. The printing plate 150 has a leading edge portion 152 and a trailing edge portion 154. As shown in FIG. 3, the lockup bar 26 has an open position in which the outer end portion 60 of the lockup bar 26 extends through the outer end 36 of the open passage 34. The cylindrical surface 66 on the lockup bar 26 is then spaced outwardly from the cylindrical surface 16 of the body 14. The printing plate 150 is initially mounted on the plate cylinder 10 with its leading edge portion 152 extending into the outer end 36 of the open passage 34, and with its trailing edge portion 154 extending over the tension spring 76. The tension spring 76 takes up tolerances in the length of the printing plate 150 between the leading and trailing edge portions 152 and 154. Specifically, the tension spring 76 will flex downward to the left as viewed in FIG. 3 if the printing plate 150 is short between the opposite edge portions 152 and 154. The tension spring 76 will flex upward to the right as viewed in FIG. 3 if the printing plate 150 is long between the opposite edge portions 152 and 154.

The lockup bar 26 is movable from the open position, as shown in FIG. 3, to a closed position, as shown in FIG. 4. When the lockup bar 26 is moved inward to the closed position, the retainer spring 78 is forced into engagement with both the leading and trailing edge portions 152 and 154 of the printing plate 150. The retainer spring 78 and the tension spring 76 then hold the printing plate 150 securely on the plate cylinder 10. The cylindrical surface 66 on the lockup bar 26 is flush with the cylindrical surface 16 of the body 14, and the gap 158 between the leading and trailing edge portions 152 and 154 of the printing plate 150 is substantially closed.

In the preferred embodiment of the invention, the lockup bar 26 does not move inward along a radius of the cylinder 10. Instead, the lockup bar 26 moves inward along the transverse axis 30. With reference to a radius extending from the longitudinal central axis 12 to the opening 36, the lockup bar 26 thus moves inward at an angle to such a radius. Most preferably, the lockup bar 26 moves inward at an angle of approximately 45° to such a radius, as shown in the drawings. The tension spring 76 can pull the trailing edge portion 154 of the printing plate into the open passage 34 farther and more easily at an angle than directly along a radius, because it does not have to bend the printing plate 150 as much to do so.

The lockup bar 26 is moved from the closed position to the open position by pneumatic pressure, and is moved back from the open position to the closed position by the coil springs 98. When pneumatic pressure is directed from the source 120 to the lockup bar 26 through the air flow passages, the pneumatic pressure moves the lockup bar 26 outward of the open passage 34 against the force of the coil springs 98. Specifically, the pressurized flow of air is first directed against the lockup bar 26 in a relief space defined between the inner end surface 39 of the open passage 34 and the inner end surface 71 of the lockup bar 26. In the preferred embodiment of the invention, the relief space is provided by a recessed portion of the surface 71, but could be provided by a recessed portion of the surface 39. The relief space enables the air flow to develop an initial force against the lockup bar 26 which is greater than the initial force it could develop if the surfaces 71 and 39 were flush with each other. The lockup bar 26 is held in the open position, as shown in FIG. 1, while the pneumatic pressure is maintained. After the printing plate 150 is initially mounted on the plate cylinder 10 as shown in FIG. 3, the pneumatic pressure is relieved.

The coil springs 98 then move the lockup bar 26 inward from the open position to the closed position.

When the plate cylinder 10 rotates during a printing operation in a printing unit, the mass of the lockup bar 26 subjects the lockup bar 26 to a centrifugal force which increases as the rotational speed of the plate cylinder 10 increases. The centrifugal force acting on the lockup bar 26 is directed radially outward, as indicated generally by the line $F_1$ shown in FIG. 1. The centrifugal force has a transverse component acting in a direction outward along the transverse axis 30, i.e., in a direction to the left as viewed in FIG. 1. The transverse component of the centrifugal force urges the lockup bar 26 to move outward from the closed position toward the open position against the force of the coil springs 98.

If the lockup bar 26 were moved from the closed position toward the open position by the centrifugal force, the printing plate 150 would become loosened on the plate cylinder 10 during the printing operation. However, the mass of the balance bar 28 similarly subjects the balance bar 28 to a centrifugal force when the plate cylinder 10 rotates. The centrifugal force acting on the balance bar 28 also is directed radially outward, as indicated generally by the line $F_2$ shown in FIG. 1. The centrifugal force acting on the balance bar 28 has a transverse component acting along the transverse axis 30 in a direction to the right as viewed in FIG. 1. The mass of the balance bar 28 is designed so that the transverse component of the centrifugal force which acts to the right on the balance bar 28 is at least equal to the amount, if any, that the force of the coil springs 98 is exceeded by the transverse component of the centrifugal force which acts to the left on the lockup bar 26. Since the balance bar 28 is connected to the lockup bar 26 by the transversely extending connecting pins 100, the transverse components of the centrifugal forces are directed oppositely to each other. The balance bar 28 thus ensures that the centrifugal force acting to the left on the lockup bar 26 cannot move the lockup bar 26 out of the closed position even if that centrifugal force increases to a level greater than the force of the coil springs 98. The lockup bar 26 is therefore held securely in the closed position by the coil springs 98 even when it is subjected to substantial centrifugal forces at high rotational speeds.

Alternatively, the mass of the balance bar 28 can be designed so that the centrifugal force acting to the right on the balance bar 28 is greater than the centrifugal force acting to the left on the lockup bar 26. The lesser centrifugal force then could not move the lockup bar 26 outward even in the absence of a spring force opposing it.

The lockup bar 26 can be removed from the plate cylinder 10 for service. The lockup bar 26 is removed by first directing pneumatic pressure against the lockup bar 26 to move it into the open position. A disassembly rod 170 (FIG. 1) is then inserted temporarily in the cylindrical chamber 52. The disassembly rod 170 spaces the balance bar 28 from the inner surface 50, and holds the balance bar 28 and the connecting pins 100 in the positions shown in FIG. 1. The lockup bar 26 is thus released from the force of the coil springs 98 by the disassembly rod 170. The abutment surfaces 75 in the slots 74 in the lockup bar 26 can then slide out from behind the heads 102 of the connecting pins. The end cap 20 of the plate cylinder 10 is then removed so that the lockup bar 26 can be shifted longitudinally to the left, as viewed in FIG. 2, relative to the connecting pins 100. The heads 102 of the connecting pins 100 are thus moved off of the abutment surfaces 75 in the slots 74. The lockup bar 26 is next moved transversely outward until the heads 102 of the connecting pins 100 are located outside of the slots 74, and is further moved transversely from the plate cylinder 10.

Figure 5:
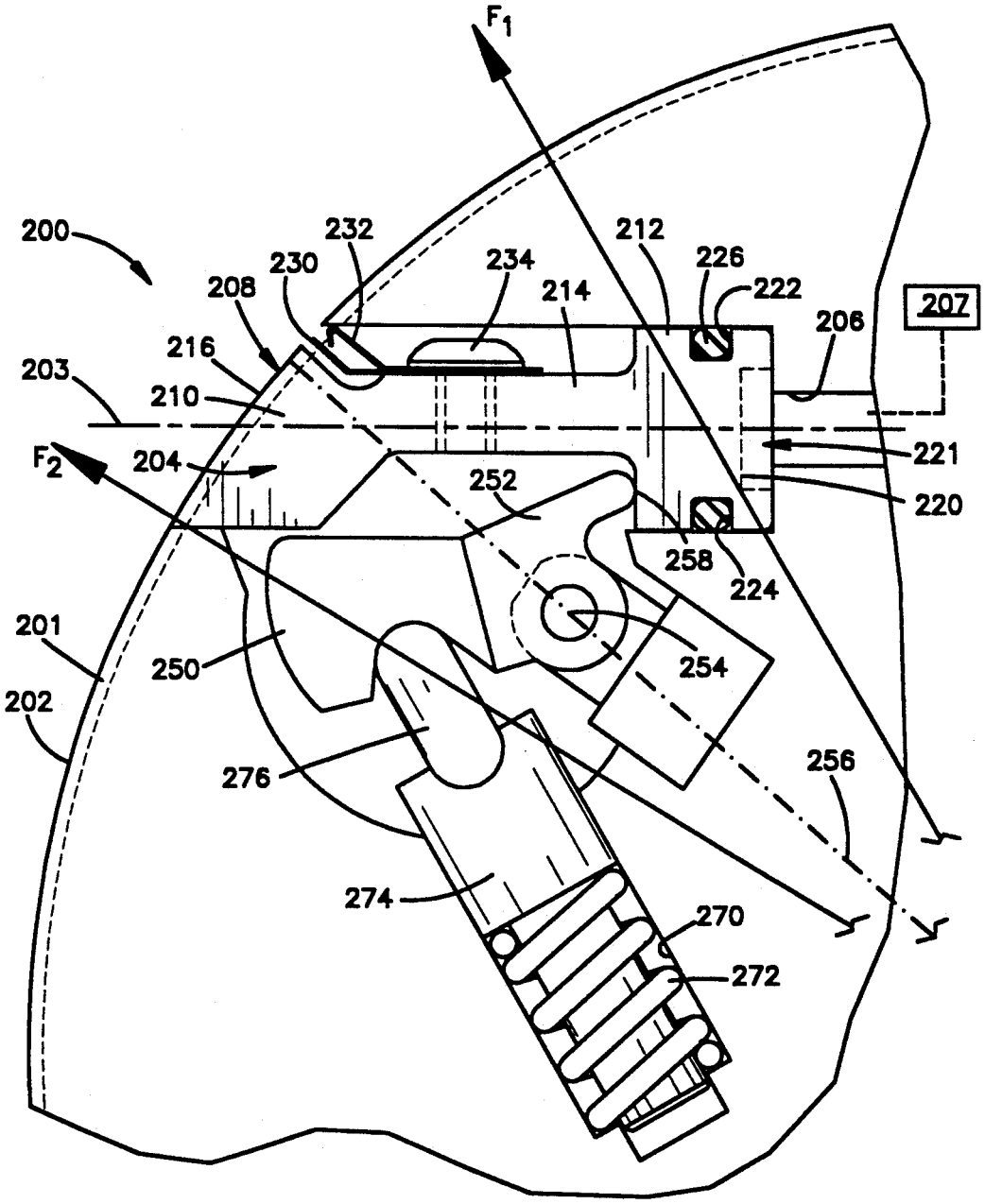
FIG. 5 is a partial view of a plate cylinder constructed in accordance with an alternative embodiment of the present invention.

A second embodiment of the present invention is shown in FIG. 5. The second embodiment of the present invention is a plate cylinder 200 having a body 201 with cylindrical outer surface 202. The plate cylinder 200 has a transverse axis 203 like the transverse axis 30 described above with reference to the plate cylinder 10. An open passage 204 extends inward from the cylindrical outer surface 202 along the transverse axis 203. A pneumatic passage 206 communicates a source of pneumatic pressure 207 with the open passage 204.

A lockup bar 208 is located in the open passage 204. The lockup bar 208 has an outer end portion 210, an inner end portion 212 and an intermediate portion 214. The outer end portion 210 of the lockup bar 208 has an outer surface 216 with a cylindrical contour matching the contour of the cylindrical outer surface 202 of the body 201. The inner end portion 212 of the lockup bar 208 has a recessed rear surface 220 defining a relief space 221, an upper groove 222 and a lower groove 224. The recessed rear surface 220 faces the pneumatic passage 206. An O-ring 226 extends around the inner end portion 212 in the grooves 222 and 224, and establishes a pneumatic seal between the pneumatic passage 206 and the outer end of the open passage 204. The intermediate portion 214 of the lockup bar 208 supports a tension spring 230 and a retainer spring 232. The tension spring 230 and the retainer spring 232 are leaf springs which extend along the length of the lockup bar 208, and are fixed to the lockup bar 208 by fasteners 234.

The plate cylinder 200 also includes a balance member 250 and a pivot member 252. The pivot member 252 is supported for pivotal movement about a longitudinal axis 254. The longitudinal axis 254 intersects, and is perpendicular to, a diametrical line 256 which defines the diameter of the cylindrical outer surface 202. A contact surface 258 on the pivot member 252 is located on one side of the diametrical line 256. The balance member 250 is located substantially on the opposite side of the diametrical line 256. The balance member 250 is fixed to the pivot member 252 and moves about the longitudinal axis 254 with the pivot member 252.

The plate cylinder 200 further includes a plurality of cylindrical bores 270. The bores 270 are spaced from each other along the length of the plate cylinder 200. Each of the bores 270 contains a coil spring 272 and a spring plunger 274. An elongated plunger bar 276 is located between the spring plungers 274 and the balance member 250. The coil springs 272 exert a spring force against the balance member 250 through the spring plungers 274 and the plunger bar 276. The spring force exerted against the balance member 250 by the coil springs 272 urges the balance member 250 and the pivot member 252 to move about the longitudinal axis 254 in a clockwise direction, as viewed in FIG. 5. The coil springs 272 thus press the contact surface 258 on the pivot member 252 against the inner end portion 212 of the lockup bar 208, and urge the lockup bar 208 to move inward along the transverse axis 203.

The lockup bar 208 is movable along the transverse axis 203 between a closed position and an open position. When the lockup bar 208 is in its open position, it extends outward from the open passage 204. A printing plate can then be mounted on the plate cylinder 200. When the lockup bar 208 is in its closed position, as shown in FIG. 5, the cylindrical surface 216 on the lockup bar 208 is flush with the cylindrical surface 202 of the body 201. The tension spring 230 and the retainer spring 232 are then located in positions to hold a printing plate on the plate cylinder 200 in the same manner as shown in FIG. 4.

The lockup bar 208 is moved from the closed position to the open position by pneumatic pressure, and is moved back from the open position to the closed position by the coil springs 272. When pneumatic pressure is directed from the source 207 to the recessed rear surface 220 of the lockup bar 208, the pneumatic pressure moves the lockup bar 208 outward along the transverse axis 203 to the open position against the force of the coil springs 272. The balance member 250 and the pivot member 252 are simultaneously moved against the force of the coil springs 272 in a counterclockwise direction. The lockup bar 208 is held in the open position while the pneumatic pressure is maintained. After a printing plate is mounted on the plate cylinder 200, the pneumatic pressure is relieved. The coil springs 272 then move the balance member 250 and the pivot member 252 about the longitudinal axis 254 in a clockwise direction to move the lockup bar 208 inward from the open position to the closed position.

When the plate cylinder 200 rotates during a printing operation in a printing unit, the mass of the lockup bar 208 subjects the lockup bar 208 to a centrifugal force which increases as the rotational speed of the plate cylinder 200 increases. The centrifugal force acting on the lockup bar 208 is directed radially outward, as indicated generally by the line $F_1$ shown in FIG. 5. The centrifugal force has a transverse component acting in a direction outward along the transverse axis 203. The transverse component of the centrifugal force urges the lockup bar 208 to move outward of the open passage 204 from the closed position toward the open position against the force of the coil springs 272.

The mass of the balance member 250 similarly subjects the balance member 250 to a centrifugal force when the plate cylinder 200 rotates. The centrifugal force acting on the balance member 250 is directed radially outward, as indicated generally by the line $F_2$ shown in FIG. 5. The centrifugal force acting on the balance member 250 urges the balance member 250 to move about the longitudinal axis 254 in a clockwise direction. The centrifugal force acting on the balance member 250 thus presses the contact surface 258 on the pivot member 252 against the inner end portion 212 of the lockup bar 208, and thereby urges the lockup bar 208 to move inward along the transverse axis 203.

The mass of the balance member 250 is designed so that the centrifugal force acting on the balance member 250 causes the contact surface 258 to press against the lockup bar 208 with a force that is at least equal to the amount, if any, that the force of the coil springs 272 is exceeded by the transverse component of the centrifugal force which urges the lockup bar 208 to move outward along the transverse axis 203. The pivot member 252 is designed so that the contact surface 258 applies such a force against the lockup bar 208 in an inward direction parallel to the transverse axis 203. Therefore, if the centrifugal force component which urges the lockup bar 208 to move outward from its closed position were to increase above the force of the coil springs 272, it would be offset by an opposing centrifugal force component. The lockup bar 208 therefore remains in its closed position even when subjected to substantial centrifugal forces when the plate cylinder 10 rotates at high speeds. As in the first embodiment of the invention described above, the centrifugal force component acting inwardly against the lockup bar 208 can be designed to exceed the centrifugal force components acting outwardly. The spring force then would not be needed to oppose the outwardly directed force.

From the above description of the invention, those skilled in the art will perceive improvements, changes and modifications. Such improvements, changes and modifications within the skill of the art are intended to be covered by the appended claims.

Having described the invention, the following is claimed:

1. A rotatable plate cylinder (10) for supporting a printing plate (150), said plate cylinder (10) comprising:

a body (14) with a cylindrical outer surface (16);

locking means for securing the printing plate (150) to said plate cylinder (10), said locking means including means for defining a passage (34) in said plate cylinder (10), said passage (34) having an opening (36) at said cylindrical outer surface (16) and extending into said plate cylinder (10) from said opening (36);

said locking means further including a locking member (26) supported for movement in said passage (34) between a closed position and an open position, said locking means securing the printing plate (150) to said plate cylinder (10) when said locking member (26) is in said closed position, and releasing the printing plate (150) from said plate cylinder (10) when said locking member (26) is in said open position, said locking member (26) being movable outward of said passage (34) from said closed position toward said open position;

the mass of said locking member (26) subjecting said locking member (26) to a first centrifugal force when said plate cylinder (10) rotates, said first centrifugal force urging said locking member (26) to move outward of said passage (34) from said closed position toward said open position;

a balance member (28), the mass of said balance member (28) subjecting said balance member (28) to a second centrifugal force when said plate cylinder (10) rotates; and force balancing means (100) for directing said second centrifugal force against said locking member (26) oppositely to said first centrifugal force and in an amount great enough not to permit said first centrifugal force to move said locking member (26) outward of said passage (34) from said closed position toward said open position.

2. A rotatable plate cylinder (10) as defined in claim 1 further comprising spring means (98) for applying a spring force biasing said locking member (26) inward of said passage (34) to said closed position, said spring means (98) directing said spring force against said locking member (26) oppositely to said first centrifugal force.

3. A rotatable plate cylinder (10) as defined in claim 2 wherein said force balancing means (100) directs said second centrifugal force against said locking member (26) in an amount greater than said first centrifugal force, whereby said first centrifugal force cannot move said locking member (26) outwardly of said passage (34)

from said closed position toward said open position against said second centrifugal force.

4. A rotatable plate cylinder (10) as defined in claim 2 further comprising pneumatic means (120–126) for moving said locking member (26) outward of said passage (34) from said closed position to said open position against said spring force.

5. A rotatable plate cylinder (10) as defined in claim 2 wherein said force balancing means (100) directs said spring force to said locking member (26) from said balance member (28).

6. A rotatable plate cylinder (10) as defined in claim 1 wherein said locking member (26) is movable outward of said passage (34) from said closed position toward said open position in a direction transverse to a diametrical line (32) defining the diameter of said cylindrical outer surface (16), said opening (36) being located on one side of said diametrical line (32), said balance member (28) being located on the opposite side of said diametrical line (32).

7. A rotatable plate cylinder (10) as defined in claim 6 wherein said locking member (26) comprises a lockup bar (26), said lockup bar (26) being elongated along the length of said plate cylinder (10), said balance member (28) comprising a balance bar (28), said balance bar (28) being elongated along the length of said plate cylinder (10), said force balancing means (100) comprising a connecting member (100) extending from said lockup bar (26) to said balance bar (28) in said transverse direction.

8. A rotatable plate cylinder (10) as defined in claim 7 wherein said transverse direction is perpendicular to said diametrical line (32).

9. A rotatable plate cylinder (200) as defined in claim 1 wherein said force balancing means (252) supports said balance member (250) to pivot about an axis (254), said first centrifugal force urging said balance member (250) to pivot in a first direction about said axis (254), said second centrifugal force urging said balance member (250) to pivot in a second direction about said axis (254).

10. A rotatable plate cylinder (10) as defined in claim 1 wherein said locking member (26) is movable inward of said passage (34) from said open position toward said closed position in a direction extending at an angle to a radius of said cylinder (10) which extends from the longitudinal central axis (12) of said cylinder (10) to said opening (36), whereby said locking means takes up looseness in the printing plate (150) upon movement of said locking member (26) toward said closed position.

11. A rotatable plate cylinder (10) as defined in claim 10 wherein said angle is approximately 45°.

12. A rotatable plate cylinder (10) as defined in claim 1 further comprising a safety block (42) located in said passage (34), said safety block (42) blocking movement of said locking member (26) out of said passage (34).

13. A rotatable plate cylinder (10) as defined in claim 1 wherein said locking means further includes a first spring (78) supported on said locking member (26) to move in said passage (34) with said locking member (26), said first spring (78) having first surface means for engaging a first edge portion (152) of the printing plate (150).

14. A rotatable plate cylinder (10) as defined in claim 13 wherein said locking means further includes a second spring (76) supported on said locking member (26) to move in said passage (34) with said locking member (26), said second spring (76) having second surface means for engaging a second edge portion (254) of the printing plate (150).

15. A rotatable plate cylinder (10) as defined in claim 1 wherein said force balancing means (100) supports said balance member (28) for movement in said plate cylinder (10), said force balancing means (100) including a connecting member (102) which is connected to said balance member (28) to move with said balance member (28), said connecting member (102) being movable against a surface (75) of said locking member (26) in a first direction to move said locking member (26) with said balance member (28) in said first direction, and said connecting member (102) being movable away from said surface (75) of said locking member (26) in a second direction to release said locking member (26) from said balance member (28), said rotatable plate cylinder (10) further comprising means (170) for holding said connecting member (102) in a position spaced from said surface (75).

16. A rotatable plate cylinder (10) as defined in claim 15 wherein said spring means comprises a disassembly rod (170).

17. A rotatable plate cylinder 10 as defined in claim 16 wherein said surface (75) is located in a slot (74) in said locking member (26).

18. A rotatable plate cylinder (10) as defined in claim 1 wherein said passage (34) has an inner end portion (38), and further comprising sealing means (132) for blocking the passage of dirt from said opening (36) to said inner end portion (38).

19. A rotatable plate cylinder as defined in claim 4 wherein said passage (30) has an inner end surface (39), said locking member (26) having an inner end surface (71) in contact with said inner end surface (39) of said passage (30) when said locking member (26) is in said closed position, said inner end surfaces (39, 71) defining a relief space therebetween when said locking member (26) is in said closed position, said pneumatic means first directing a pressurized flow of air into said relief space when directing a pressurized flow of air against said locking member (26).

20. A rotatable plate cylinder (10) as defined in claim 19 wherein said space is defined at least in part by a recessed portion of said inner end surface (39) of said locking member.

* * * * *